US010546569B1

(12) United States Patent
Hawdon et al.

(10) Patent No.: US 10,546,569 B1
(45) Date of Patent: Jan. 28, 2020

(54) DRUM BASED MUSICAL INSTRUMENT, AND METHOD INCORPORATING INTERNAL KICK DRUM

(71) Applicants: Mark Raymond Hawdon, Woodstock, NY (US); Nicholas Jon Guccione, Woodstock, NY (US)

(72) Inventors: Mark Raymond Hawdon, Woodstock, NY (US); Nicholas Jon Guccione, Woodstock, NY (US)

( * ) Notice: Subject to any disclaimer, the term of this patent is extended or adjusted under 35 U.S.C. 154(b) by 0 days.

(21) Appl. No.: 16/357,880

(22) Filed: Mar. 19, 2019

(51) Int. Cl.
*G10H 1/32* (2006.01)
*G10H 3/12* (2006.01)

(52) U.S. Cl.
CPC ..... *G10H 3/12* (2013.01)

(58) Field of Classification Search
CPC ..... G10H 1/32
USPC ..... 84/746
See application file for complete search history.

(56) References Cited

U.S. PATENT DOCUMENTS 3,818,791 A * 6/1974 Zickos ..... G10D 13/028 84/411 R
3,956,959 A * 5/1976 Ebihara ..... G10D 13/08 84/725
7,807,910 B1 * 10/2010 Berardo ..... G10D 13/08 84/411 R
9,589,552 B1 * 3/2017 Nishi ..... G10H 3/12
2008/0121088 A1 * 5/2008 Curet Troche ..... G10D 13/02 84/413
2010/0043622 A1 * 2/2010 Sandson ..... G10D 13/00 84/421
2011/0041670 A1 * 2/2011 Ferguson ..... G10D 13/02 84/415
2014/0041508 A1 * 2/2014 Trask ..... G10D 13/025 84/415
2015/0221290 A1 * 8/2015 Wei ..... G10D 13/006 84/730
2015/0348521 A1 * 12/2015 Nigro ..... G10D 13/026 84/421
2017/0125002 A1 * 5/2017 Steele ..... G10H 3/146

* cited by examiner

*Primary Examiner* — Jeffrey Donels
(74) *Attorney, Agent, or Firm* — Dunlap Bennett & Ludwig PLLC

(57) ABSTRACT

A modified and improved electronic bongo instrument embodying a kick drum and an operatively associated, selectively foot-activated kick pedal to create a new single unified instrument. The instrument has a novel hourglass shell for housing its own stand-alone power source, amplification and input/output units, with analog/digital upload capabilities, while additionally affording functionality associated with a new, completely portable and innovative method of musical collaboration, as well as a meditative and therapeutic application, and a physical exercise tool, and/or a children's toy.

9 Claims, 5 Drawing Sheets

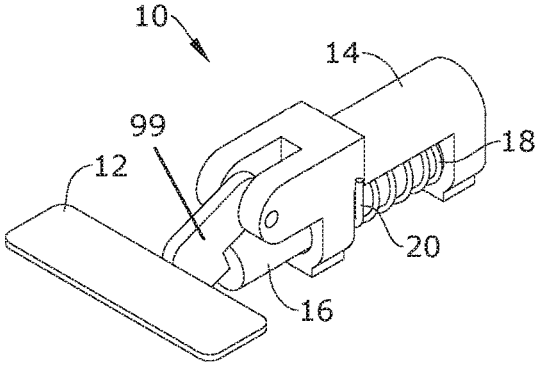
FIG.4
FIG.5
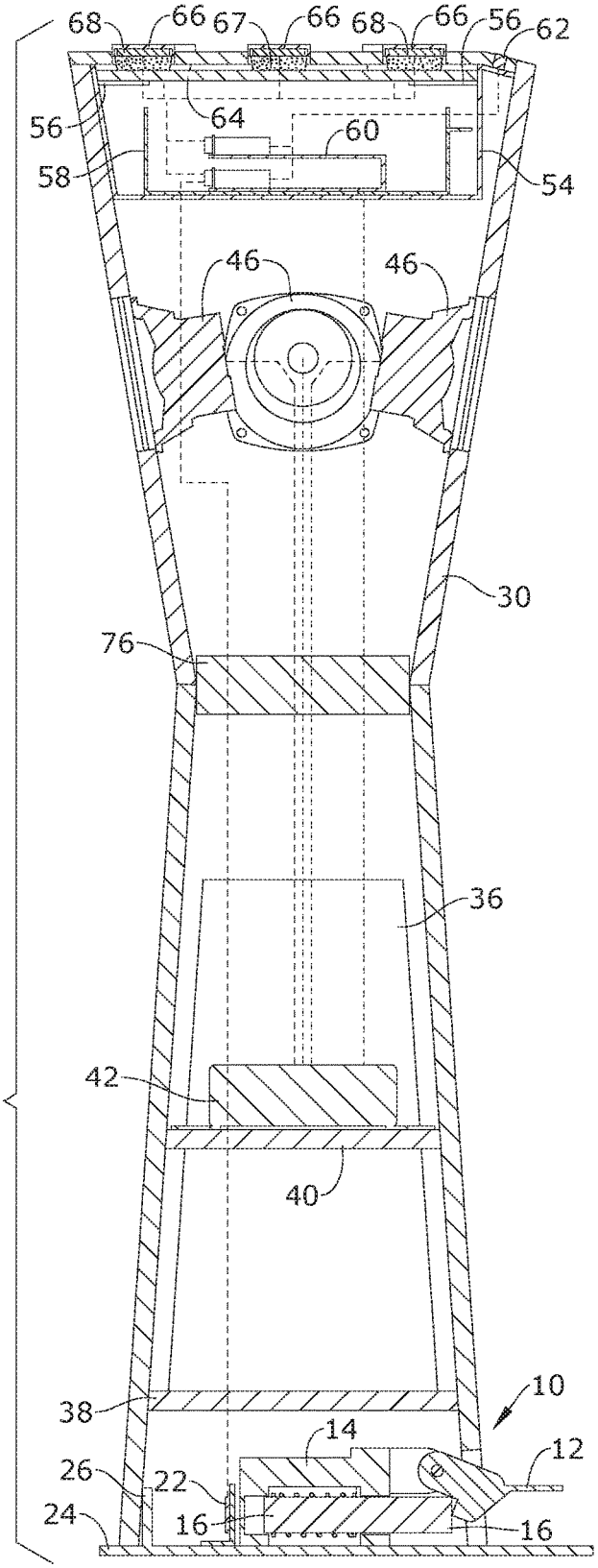

DRUM BASED MUSICAL INSTRUMENT, AND METHOD INCORPORATING INTERNAL KICK DRUM

BACKGROUND OF THE INVENTION

The present invention relates to musical instruments and, more particularly, a new improved bongo which incorporates a bass kick drum to create a new single unified instrument, and a method of playing and drumming the same.

Traditionally when a percussionist plays the bongos and taps their foot, the motion of the foot is not utilized. There currently is no bongo or congas (percussion instrument) that integrates a kick drum and an operatively associated kick pedal. In other words, every bongo in the world is incapable of striking a bass drum via a kick pedal and so the musicians tapping foot cannot become involved in the creation of the music through the instrument, wherein the hands and the feet are involved in the creation of the music in bodily harmony with the instrument.

As can be seen, there is a need for a new improved bongo which incorporates a bass kick drum to create a new single unified instrument. The present invention includes a bongo embodying a bass drum accompaniment adapted to be selectively activated via a foot pedal activation, wherein the bongo is a stand-alone, self-contained, battery-operated, amplified, and partially solar powered instrument. The novel bongo of the present invention provides a built-in foot pedal that strikes an integrated kick bass drum, emanating multiple and diverse percussion sounds through its built-in amplifier and speakers.

As a result, the present invention is adapted to provide the following: independent, electronically self-powered percussion and other musical capabilities; a stand-alone amplification unit (speakers with audible volume) having multiple inputs for external instruments and analog/digital upload capabilities. This invention solves the problem for a percussionist who wants a bass drum accompaniment while playing a bongo—but does not have a second percussionist for accompaniment.

Furthermore, the present invention provides functionality for meditative and therapeutic applications, by utilizing the various striking techniques and sounds it creates, to calm and relieve the user and listeners; by either utilizing the built-in speakers, and/or headphones. The instrument can be used as a physical exercise tool enabling a vigorous workout; and for utilization as a children's toy and instructional device for creating music and assisting coordination and dexterity.

Traditionally when a percussionist plays the bongos and taps their foot, the motion of the foot is not utilized. However, with this new invention, the tapping foot becomes at one with the hands and music is made in bodily harmony. Thus, the hands and the feet are involved in the creation of the music.

The invention is constructed in a way whereby the bass drum is not seen, yet is incorporated integrally into the body of the bongo, and can be operated by the drummer while still playing the bongo. This solution elegantly solves the problem of needing a bass drum accompaniment while simultaneously facilitating and creating a new methodology for playing the bongo itself.

The present invention can be made in the traditional sense of a drum using stretched skins or other material to create sound, or it can be made using modern electronic technology for the production of sound.

Therefore, the present invention is unique, and fills a void in musical instruments by enabling a musician to play the bongo and a bass drum accompaniment at the same time through a single drum. Thus, a bongo drummer no longer needs a second drum, nor drummer, for bass; and can perform independently creating both sounds simultaneously without accompaniment.

SUMMARY OF THE INVENTION

In one aspect of the present invention, a drum-based musical instrument includes the following: an hourglass shape housing defined by an inwardly tapering elongated first portion and an inwardly tapering second portion, wherein the first and elongated second portions extend from a non-tapered end to a tapered end, and wherein the two tapered ends abutt; the first non-tapered end adapted to create sound by drumming; and a kick drum pedal assembly provided adjacent to the second non-tapered end, wherein the kick drum pedal assembly is coupled to a kick drum internally housed within the second portion.

In another aspect of the present invention, drum-based musical instrument includes the following: an hourglass shape housing defined by an inwardly tapering elongated first portion and an inwardly tapering second portion, wherein the first and elongated second portions extend from a non-tapered end to a tapered end, and wherein the two tapered ends abutt; a plurality of striking pads along the first non-tapered end, wherein the striking pads are adapted to produce a drum sound; a kick drum pedal assembly provided adjacent to the second non-tapered end, wherein the kick drum pedal assembly is coupled to a kick drum internally housed within the second portion, wherein the kick drum pedal assembly is operated by a piston pedal; and a drum machine processor housed within the hourglass shape housing, wherein the drum machine processor is operatively associated with the plurality of striking pads and the kick drum pedal assembly, wherein drum machine processor is electronically amplified by a built-in amplifier, equalizer and speaker.

In yet another aspect of the present invention, method of enabling a musician to play the bongo and a bass drum accompaniment at the same time through a single drum includes the following: providing the above-mentioned drum-based musical instrument; manually drumming the striking pads; and simultaneously foot-operating the internal kick drum via the kick drum pedal assembly.

These and other features, aspects and advantages of the present invention will become better understood with reference to the following drawings, description and claims.

BRIEF DESCRIPTION OF THE DRAWINGS

FIG. 4 is a detailed perspective view of an exemplary embodiment of a kick drum pedal assembly of the present invention;

FIG. 5 is a section view of an exemplary embodiment of the present invention, taken along line 5-5-in FIG. 1, with wiring connections shown in schematic dashed lines for clarity;

DETAILED DESCRIPTION OF THE INVENTION

Figure 1:
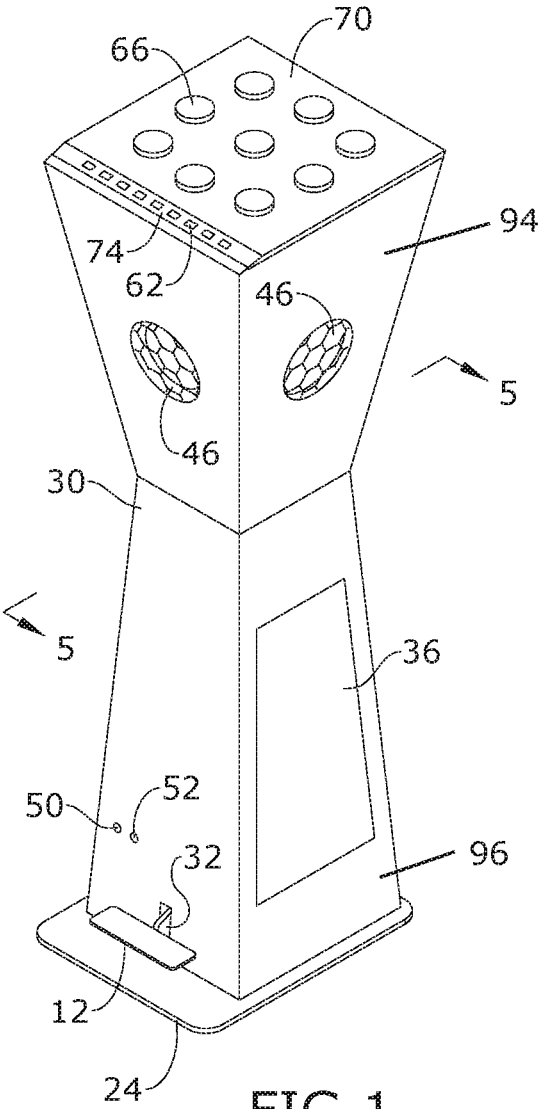
FIG. 1 is a front perspective view of an exemplary embodiment of the present invention.
Figure 2:
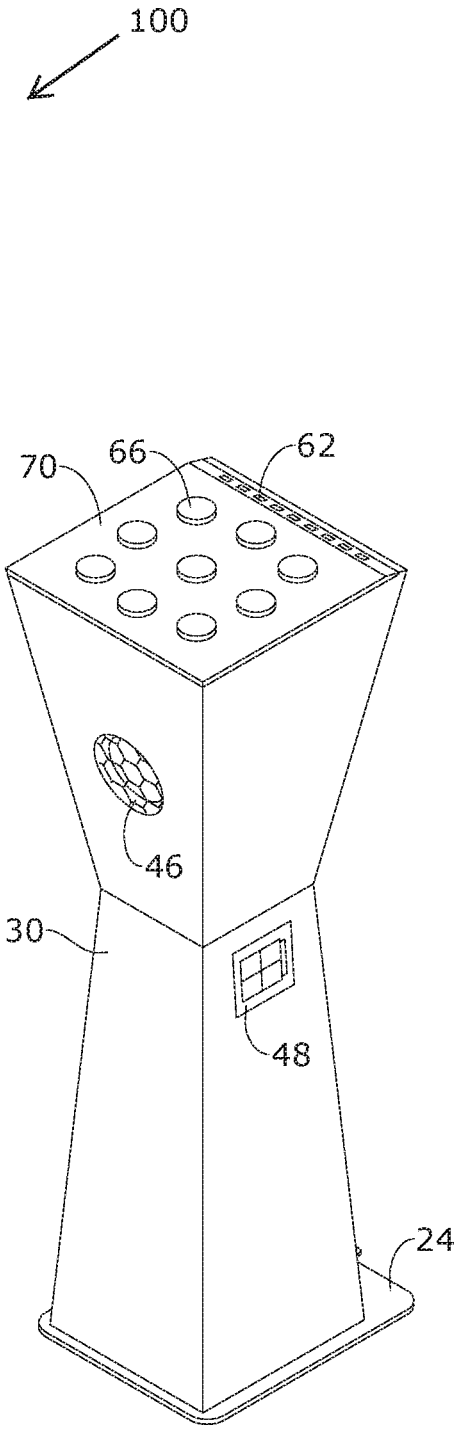
FIG. 2 is a rear perspective view of an exemplary embodiment of the present invention.
Figure 3:
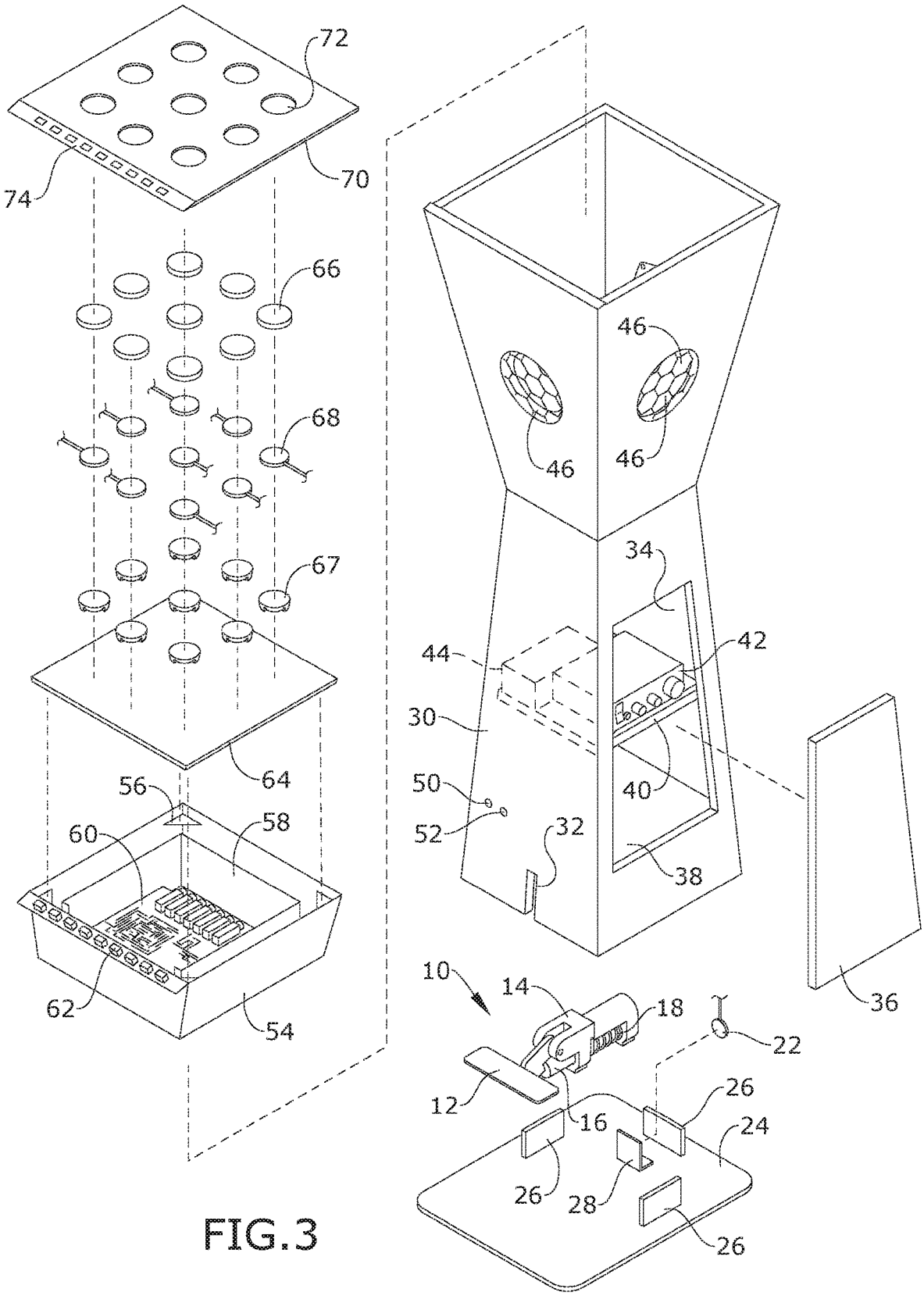
FIG. 3 is an exploded view of an exemplary embodiment of the present invention, with wiring not shown for clarity.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring now to FIGS. 1 through 10, the present invention may provide an improved modified electronic bongo 100, having a unique hourglass shaped drum shell or housing 30. The housing 30 may have two polyhedron portions, a first portion 94 and a second portion 96. It should be understood that each polyhedron may have rounded as opposed to sharp corners or vertices. Each polyhedron may be generally a rectangular cuboid that tapers inward, wherein the tapered ends of the two polyhedrons abutt to form the unique hourglass shape of the housing 30. Internally, within the housing 30, a center block 76 may extend so as to brace this abutting of the tapered ends, as illustrated in FIG. 5. The opposing (non-tapered) end of the first portion 94 provides an ideal striking surface, while the opposing end of the second portion 96 enables a stable support footing.

Each polyhedron may extend approximately one to two feet between the tapered end and the non-tapered end. The tapered end may have a surface area between ½ and 1 and ½ foot. The hourglass shape enables the user to easily straddle the instrument, and comfortably play the foot pedal with the foot, while keeping the knees and body in a comfortable position while seated, and/or can be easily tilted slightly while standing.

It should be understood by those skilled in the art that the use of directional terms such as upper, top, upward, lower, downward, bottom and the like are used in relation to the illustrative embodiments as they are depicted in the figures, the upward direction (or top) being toward the top of the corresponding figures and a downward direction (or bottom) being toward the bottom of the corresponding figure.

The first portion 94 may include a top striking surface 70 providing a plurality of touch-sensitive areas or strike pads 66, each strike pad 66 being electrically connected to an electronic "pick-up" (sensor) 68, wherein each sensor 68 may be associated with a sensor pick up support cup 67 disposed on a drum pad plate 64 just downward of the top striking surface 70.

The sensors 68 are adapted to trigger MIDI (Musical Instrument Digital Interface) sounds from the drum machine processor 60. These many various and interchangeable sounds can then be manipulated and selectively chosen for amplification through a built-in amplification unit 42, that is then projected through a plurality of built-in speakers 46. The speakers of 46 may be disposed within the first portion 94, wherein the output portions of the speakers 46 face openings in the first portion 94, as illustrated in FIGS. 1 through 4.

An electric power source 44 may be housed within the housing 30. In some embodiments, a solar panel 48 along an external portion of the housing 30 may be operatively associated with said power source 44.

The top striking surface 70 may provide pad slots 72 for receiving said strike pads. The top striking surface 70 may also include a control panel 74 providing control buttons 62 for electronically controlling the MIDI sounds and machine processor 60. The MIDI sounds and machine processor 60 may be disposed in an internal upper tray 54 that also supports the control buttons 62 (that are received through associated openings in the control panel 74). The upper tray 54 may have corner supports 56 as well as an inner tray 58 adapted for isolating and keeping the MIDI sounds and machine processor 60 stable during use.

The second portion 96 may provide a door slot 34 and an associated door 36 for accessing the built-in amplification unit 42, and electric power source 44, which may be supported by an equipment shelf 40. The second portion 96 may provide input jacks 50 and 52 for operatively associated external electronic components with the amplification unit 42, and electric power source 44, (for re-charging purposes, for example). Below the equipment shelf 40 and above the bottom of the second portion 96 may be an internally provided storage shelf 38.

A lower, external surface of the second portion 96 of the housing 30 may provide a kick drum pedal 12. The kick drum pedal 12 may be operatively associated with a kick drum pedal assembly 10. The kick drum pedal assembly 10 may include a piston 16, a spring 18 and spring pin 20 operatively associated with the kick drum pedal 12, by pressing down with the foot on the kick drum pedal 12, the operatively associated actuation portion 99 urges the spring-loaded spring piston 16 forward so that it makes contact with the mounted pick up 22.

Figure 6:
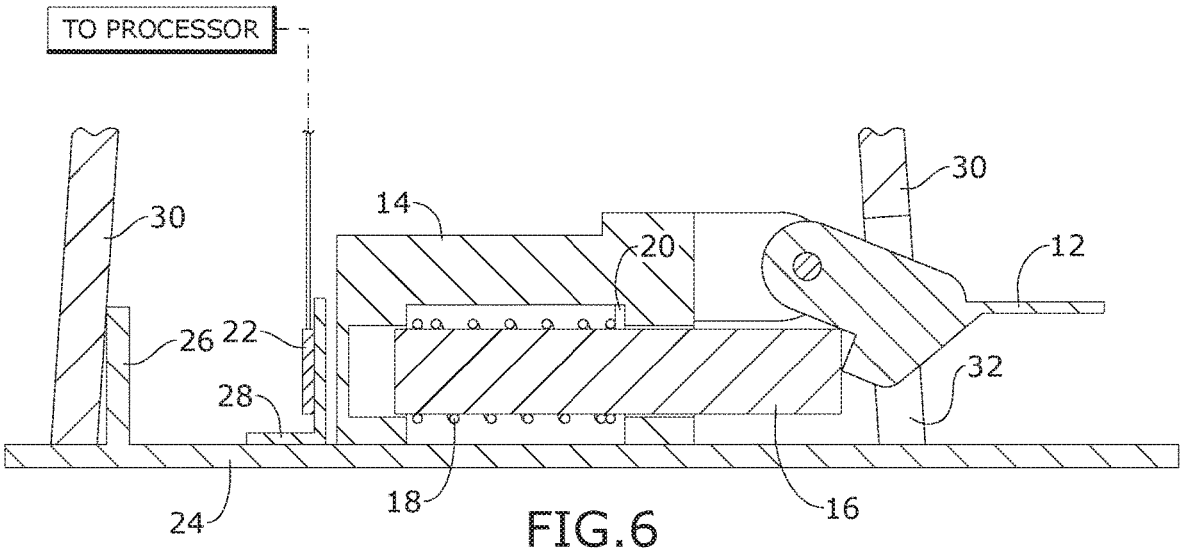
FIG. 6 is a front perspective view of an exemplary embodiment of the kick drum pedal assembly of the present invention.
Figure 7:
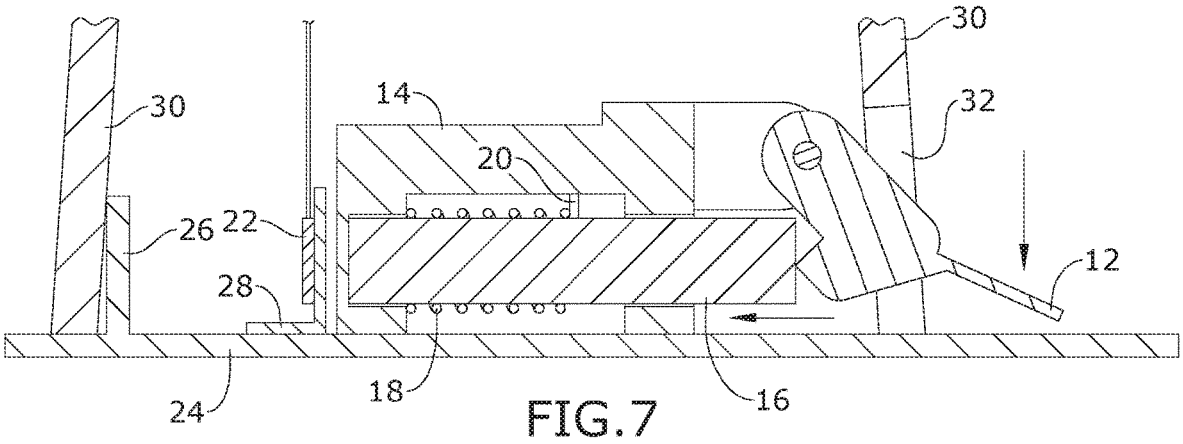
FIG. 7 is a front perspective view of an exemplary embodiment of the kick drum pedal assembly of the present invention, illustrating the operative association of the pedal 12 and piston 16 (pressing the pedal 12, moves the piston 16 through the piston housing 14 that contacts the bracket 28 and the kick drum pick-up sensor 22)
Figure 8:
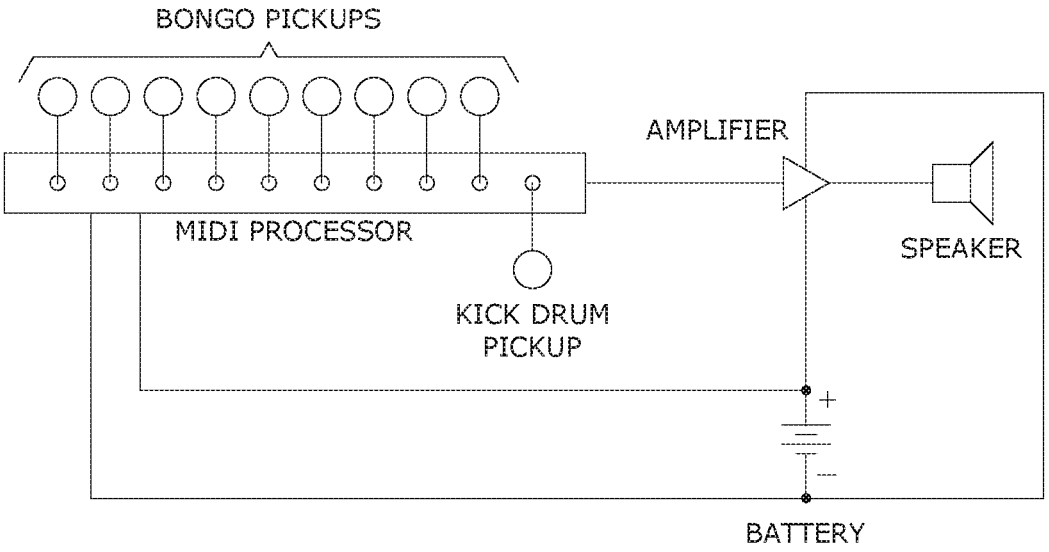
FIG. 8 is a schematic view of an exemplary embodiment of a control circuitry of the present invention.

The mounted pick up 22 is connected to the drum brain so as to operatively associate with the user's foot. In that the sound is then relayed to the drum brain, and thus produces the required sound out through the amplifier. The kick drum pedal 12 then returns to its original and pedal housing 14 for selectively striking a kick drum pick-up sensor 22, as illustrated in FIGS. 6 and 7. Said sensor 22 may be fixed to a bottom plate 24 by way of a bracket 28. The bottom plate 24 may provide one or more plate tabs 26 to connect to the second portion 96 of the housing 30. The second portion 96 may provide a pedal slot 32 so that the kick drum pedal 12 may extend outside the second portion 96, while the remainder of the kick drum pedal assembly 10 is housed therein.

The striking pads 66 and other parts of the instrument may be adapted to emanate colored lights which consistently illuminate while the unit is powered on. Similarly, other "effects" can be added to the unit, such as colored touch sensor lights, and a smoke and fog generating system.

The housing 30, and internal electronic circuit boards 60 and speakers 46 can be smaller (in time and with technological progress), to allow for a scaled down size for easier mobility and/or as a children's toy, as well as allowing for more room within the drum for storage, and to reduce the instrument's weight. The housing may be made of different materials used for the drum shell casing in addition to wood, for example metal, plexiglass, aluminum, or any other composite, whether opaque or transparent.

A user may play the percussive instrument which generates a myriad of different MIDI sounds through striking the top surface striking pads 66 as well as striking the proprietary kick pedal 12, technology, without the need of an external power source, allowing for the instrument to be played anywhere at any time, powered by its self-sufficient battery and solar powered capabilities. This opportunity makes it possible for the musician/user to create "tailor made" MIDI and drum/bongo sounds from the unit in any given situation. Be it alone, or with a group of people. Either indoors, or outdoors. And either self-amplified, or externally amplified. The present invention is capable of up to two additional inputs for amplification (e.g., a microphone, guitar, etc.). enabling the players a unique opportunity to collaborate and play their instruments simultaneously and in unison. And so, an entire percussion "section" can be reproduced and emulated with the present invention. Whereby the present invention affords the user a "kick bass" drum to play in unison with the selective playing of the strike pads 66. Truly, providing a "drum within a drum".

By striking the strike pads 66 on top of the instrument, this will activate the electronic pick-ups 68, which in turn sends a signal to the control processor (drum brain) 60. This will trigger one of many multiple midi sounds. The electronic drum processor 60 may be powered by a 30-watt 12-volt, portable guitar amplifier 42. The amplifier may sit underneath the drum brain unit 60.

The inventors have discovered that this single stand-alone unit, used by the hands and feet, creates a new joyful experience in playing music because of the way the foot pedal interacts with the present invention. The percussionist thus has a more integrated creative capacity where the accompaniment is directly created by the same person. The unique hourglass shape and supporting square base plate, allows the user to easily and consistently pivot and adjust the multiple angles of playing and striking the instrument, as well as angling the foot pedal while standing or sitting. (therefore directly affecting the final sounds being emanated from the instrument).

The inventors have discovered that the present invention affords therapeutic effects: the myriad of different sounds that can be generated from the device, offer the user a vast array of relaxing and meditative sounds and music, enabling for a peaceful "trance-like" state, thus relieving stress and worry. Perfect for people (and especially kids) who may suffer from ADD, ADHD, Anxiety, Autism, etc. Furthermore, playing the present invention requires coordination and dexterity, which are both beneficial to one's physical attributes.

Additionally, the simple act of playing the present invention is in itself, a "workout". Utilizing the limbs in a constant active state through striking the buttons on top, physically pivoting the instrument, as well as striking the foot pedal/kick drum, thus offering the user substantial physical exercise.

Figure 9:
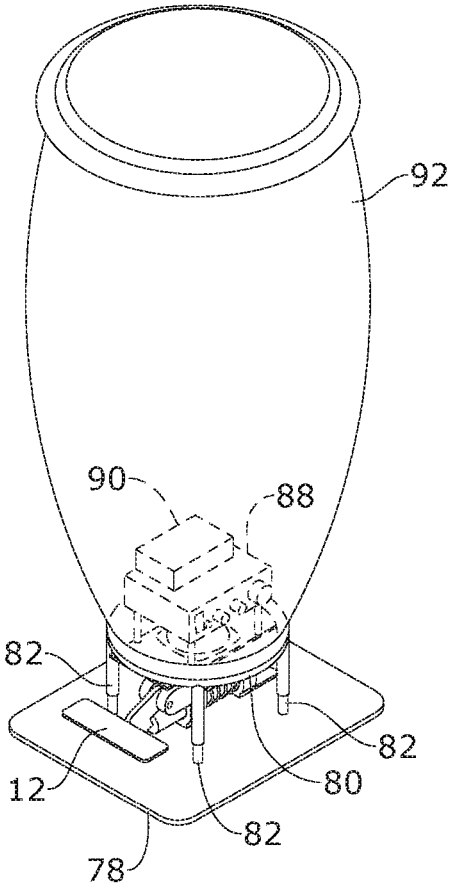
FIG. 9 is a front perspective view of the drum kick pedal assembly housed within a standard generic bongo/conga 92.
Figure 10:
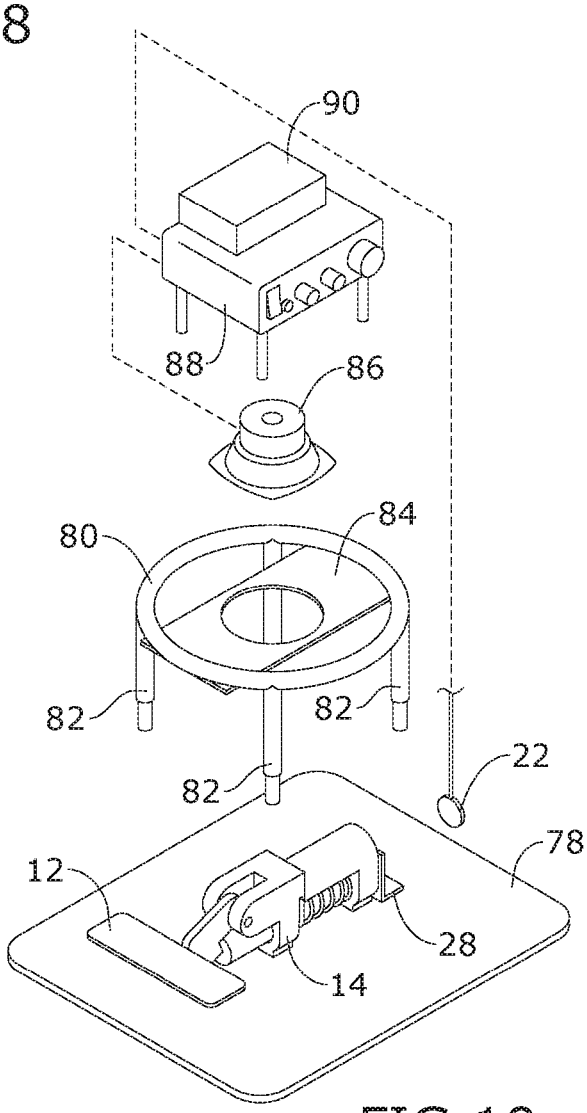
FIG. 10 is an exploded view of an exemplary embodiment of the present interchangeable kick drum pedal assembly invention with wiring connections shown in schematic dashed lines for clarity.

Referring to FIGS. 9 and 10 the inventors have discovered that by using a standard percussion instrument 92 in conjunction with the interchangeable kick drum pedal assembly as shown in FIG. 10 and a support ring 80, with adjustable legs 82 the speaker support plate 84 and speaker 86, the amplified MIDI processor 88, and the battery 90, allows the percussive instrument player to enjoy the full sound bass drum and/or MIDI sounds while simultaneously striking the top skin of the instrument 92.

It should be understood, of course, that the foregoing relates to exemplary embodiments of the invention and that modifications may be made without departing from the spirit and scope of the invention as set forth in the following claims.

What is claimed is:

1. A drum-based musical instrument, comprising:

an hourglass shape housing defined by an inwardly tapering elongated first portion and an inwardly tapering second portion, wherein the first and elongated second portions extend from a non-tapered end to a tapered end, and wherein the two tapered ends abutt;

the first non-tapered end adapted to create sound by drumming; and a kick drum pedal assembly provided adjacent to the second non-tapered end, wherein the kick drum pedal assembly is coupled to a kick drum internally housed within the second portion.

2. The drum-based musical instrument of claim 1, further comprising:

a plurality of striking pads connected to the hourglass shape housing; and a drum machine processor housed within the hourglass shape housing, wherein the drum machine process is operatively associated with the plurality of striking pads and the kick drum pedal assembly.

3. The drum-based musical instrument of claim 1, further comprising a striking surface along the first non-tapered end, wherein the striking surface may be comprised of materials compatible with housing striking pads used for the creation of sounds when struck.

4. The drum-based musical instrument of claim 1, wherein the first non-tapered end provides a plurality of striking pads along the first non-tapered end, wherein the striking pads are adapted to produce a MIDI sound.

5. The drum-based musical instrument of claim 1, wherein the kick drum pedal assembly is operated by a mechanical kick pedal.

6. The drum-based musical instrument of claim 1 wherein the kick drum pedal assembly is operated by a mechanical piston pedal.

7. The drum-based musical instrument of claim 2, wherein the internal kick drum is electronically amplified by a built-in amplifier, equalizer and speaker.

8. A drum-based musical instrument, comprising:

an hourglass shape housing defined by an inwardly tapering elongated first portion and an inwardly tapering second portion, wherein the first and elongated second portions extend from a non-tapered end to a tapered end, and wherein the two tapered ends abutt;

a plurality of striking pads along the first non-tapered end, wherein the striking pads are adapted to produce a drum or MIDI sound;

a kick drum pedal assembly provided adjacent to the second non-tapered end, wherein the kick drum pedal assembly is coupled to a kick drum internally housed within the second portion, wherein the kick drum pedal assembly is operated by a mechanical piston pedal; and a drum machine processor housed within the hourglass shape housing, wherein the drum machine processor is operatively associated with the plurality of striking pads and the kick drum pedal assembly, wherein drum machine processor is electronically amplified by a built-in amplifier, equalizer and speaker.

9. A method of enabling a musician to play the present invention with a bass drum accompaniment at the same time through a single instrument, comprising:

providing the drum-based musical instrument of claim 8; manually drumming the striking pads; and simultaneously foot-operating the internal kick drum via the kick drum pedal assembly.

* * * * *